US011282468B2

(12) United States Patent
Ho et al.

(10) Patent No.: US 11,282,468 B2
(45) Date of Patent: Mar. 22, 2022

(54) SWITCHABLE PIXEL CIRCUIT AND DRIVING METHOD THEREOF

(71) Applicant: AU Optronics Corporation, Hsin-Chu (TW)

(72) Inventors: Jia-Show Ho, Hsin-Chu (TW); Che-Chia Chang, Hsin-Chu (TW); Ming-Hung Chuang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 541 days.

(21) Appl. No.: 15/659,790

(22) Filed: Jul. 26, 2017

(65) Prior Publication Data

US 2018/0068625 A1 Mar. 8, 2018

(30) Foreign Application Priority Data

Sep. 6, 2016 (TW) ..... 105128824

(51) Int. Cl.
*G09G 3/36* (2006.01)

(52) U.S. Cl.
CPC ..... *G09G 3/3648* (2013.01); *G09G 3/3659* (2013.01); *G09G 2300/0842* (2013.01);
(Continued)

(58) Field of Classification Search
CPC .. G09G 3/3648; G09G 3/3659; G09G 3/3618; G09G 2300/0842;
(Continued)

(56) References Cited

U.S. PATENT DOCUMENTS 6,570,338 B2 * 5/2003 Bae ..... G09G 3/30 315/169.3
6,943,766 B2 9/2005 Nakamura et al.
(Continued)

FOREIGN PATENT DOCUMENTS

TW I416447 11/2013
TW 201612886 A 4/2016

OTHER PUBLICATIONS

Taiwan patent office "Office Action" dated Jun. 26, 2016, Taiwan.
European Patent Office, "Office Action", dated Feb. 22, 2018.

*Primary Examiner* — Jimmy H Nguyen
(74) *Attorney, Agent, or Firm* — WPAT, PC

(57) ABSTRACT

A pixel circuit includes a liquid crystal capacitor, a memory circuit, a driving circuit, a mode-switching circuit, and a control circuit. The memory circuit is configured to store a status signal. The driving circuit includes a first terminal configured to receive a data voltage and a second terminal electrically coupled to a first terminal of the liquid crystal capacitor, and the driving circuit is configured to be ON or OFF according to a scan signal selectively. The mode-switching circuit is configured to be ON or OFF according to a mode-switching signal selectively. The control signal is electrically coupled to the mode-switching circuit at a first node, and is configured to control the voltage level of the first node corresponding to the status signal, and output a display voltage to the liquid crystal capacitor via the mode-switching circuit when the mode-switching circuit is ON.

12 Claims, 8 Drawing Sheets

(52) U.S. Cl.
CPC ..... *G09G 2300/0857* (2013.01); *G09G 2320/0247* (2013.01); *G09G 2320/10* (2013.01); *G09G 2330/021* (2013.01); *G09G 2330/022* (2013.01)

(58) Field of Classification Search
CPC ... G09G 2300/0857; G09G 2320/0247; G09G 2320/10; G09G 2330/022; G09G 2330/021
USPC ..... 345/212, 92
See application file for complete search history.

(56) References Cited

U.S. PATENT DOCUMENTS

| | | | | |
|---|---|---|---|---|
| 2001/0052890 | A1* | 12/2001 | Miyazawa | G09G 3/3659 345/89 |
| 2002/0036627 | A1* | 3/2002 | Yokoyama | G02F 1/1362 345/204 |
| 2002/0167501 | A1 | 11/2002 | Senda et al. | |
| 2009/0141013 | A1 | 6/2009 | Nagai et al. | |
| 2012/0038604 | A1 | 2/2012 | Liu et al. | |
| 2012/0044215 | A1* | 2/2012 | Chen | G09G 3/3648 345/204 |
| 2012/0294411 | A1* | 11/2012 | Duan | G09G 3/3233 377/64 |

* cited by examiner

100

100

100

100

100

SWITCHABLE PIXEL CIRCUIT AND DRIVING METHOD THEREOF

BACKGROUND

Technical Field

This disclosure relates to a pixel circuit, and in particular, to a switchable pixel circuit.

Related Art

Recently, with the maturity of related technologies, development potential of wearable electronic devices such as smart bands and smart watches gradually attracts attention. However, the capacity of a battery that can be arranged is limited due to volume and weight requirements of a wearable electronic device.

Therefore, how to design low power-consuming display screens and pixel circuits to meet requirements that electronic devices keep outputting display frames with extremely low power consumption is one of the current important research and development topics, and is also a subject that currently needs to be improved in related art.

SUMMARY

An aspect of this disclosure is a pixel circuit. The pixel circuit includes a liquid crystal capacitor, a memory circuit, a driving circuit, a mode-switching circuit, and a control circuit. The memory circuit is configured to store a status signal. The driving circuit includes a first terminal configured to receive a data voltage and a second terminal electrically connected to a first terminal of the liquid crystal capacitor. The driving circuit is configured to be ON or OFF according to a scan signal selectively. The mode-switching circuit is configured to be ON or OFF according to a mode-switching signal selectively. The control circuit is electrically connected to the mode-switching circuit at a first node, and is configured to control a voltage level of the first node corresponding to the status signal and output a display voltage to the liquid crystal capacitor via the mode-switching circuit when the mode-switching circuit is ON.

Another aspect of this disclosure is a pixel circuit. The pixel circuit includes a liquid crystal capacitor, a memory circuit, a first transistor, a second transistor, a third transistor, a fourth transistor, a fifth transistor, and a sixth transistor. The liquid crystal capacitor includes a first terminal and a second terminal. The memory circuit is configured to store a status signal. The first terminal of the first transistor is configured to receive a drive voltage, and a control terminal of the first transistor is electrically connected to a first terminal of the memory circuit and configured to receive a status signal. A first terminal of the second transistor is electrically connected to a second terminal of the first transistor, a second terminal of the second transistor is electrically connected to the second terminal of the liquid crystal capacitor, and a control terminal of the second transistor is electrically connected to a second terminal of the memory circuit and configured to receive an inverted phase signal of the status signal. A first terminal of the third transistor is electrically connected to a data line, and a control terminal of the third transistor is electrically connected to a scan line and configured to receive a scan signal. A first terminal of the fourth transistor is electrically connected to a second terminal of the third transistor, a second terminal of the fourth transistor is electrically connected to the first terminal of the liquid crystal capacitor, and a control terminal of the fourth transistor is electrically connected to the scan line and configured to receive the scan signal. A first terminal of the fifth transistor is electrically connected to the second terminal of the third transistor, a second terminal of the fifth transistor is electrically connected to the first terminal of the memory circuit, and a control terminal of the fifth transistor is configured to receive a mode-switching signal. A first terminal of the sixth transistor is electrically connected to the first terminal of the liquid crystal capacitor. A second terminal of the sixth transistor is electrically connected to the second terminal of the first transistor, and a control terminal of the sixth transistor is configured to receive the mode-switching signal.

Still another aspect of this disclosure is a driving method. The driving method includes: in a first mode, receiving a data voltage via a first terminal of a driving circuit; enabling the driving circuit to be ON according to a scan signal selectively, so as to provide the data voltage to a liquid crystal capacitor; storing a status signal via a memory circuit when switching from the first mode to a second mode; in the second mode, enabling a mode-switching circuit to be ON; and controlling, via a control circuit, a voltage level of a first node to correspond to the status signal, so as to output a display voltage to the liquid crystal capacitor via the mode-switching circuit.

DETAILED DESCRIPTION

The following describes the embodiments with reference to the accompanying drawings in detail, so as to make the aspects of this disclosure more comprehensible. However, the provided embodiments are not intended to limit the scope of this disclosure, and the description of the operation of a structure is not intended to limit an execution sequence. Any apparatus with equivalent functions that is produced from a structure formed by a recombination of elements shall fall within the scope of this disclosure. Besides, according to industry standards and practices, the drawings are merely intended to assist the description, and are not drawn according to original dimensions. In practice, dimensions of various features may be arbitrarily increased or decreased to facilitate the description. Same elements in the description below are indicated by a same reference sign, so as to facilitate the comprehension.

The terms used in this specification and the claims generally have their ordinary meanings in the art, within the context of the disclosure, and in the specific context where each term is used, unless otherwise specifically denoted. Terms that are used to describe this disclosure are discussed below, or elsewhere in the specification, to provide additional guidance to a person skilled in the art regarding the description of this disclosure.

Besides, as used herein, the terms "including", "comprising", "having", "containing", and the like are to be understood to be open-ended, i.e., to mean including but not limited to. Besides, as used herein, "and/or" includes any one or combinations of one or more items in relevant enumerated items.

In this specification, when an element is "connected" or "coupled", it may indicate that the element is "electrically connected" or "electrically coupled". "Connected" or "coupled" may further be used to indicate that two or more elements operate cooperatively or interact with each other. Besides, although terms such as "first" and "second" are used in this specification to describe different elements, the terms are merely used to distinguish between elements or operations that are described by a same technical term. Unless clearly specified in the context otherwise, the terms are not intended to indicate specific denotations or imply a sequence or an order, and are not intended to limit the present invention.

Figure 1:
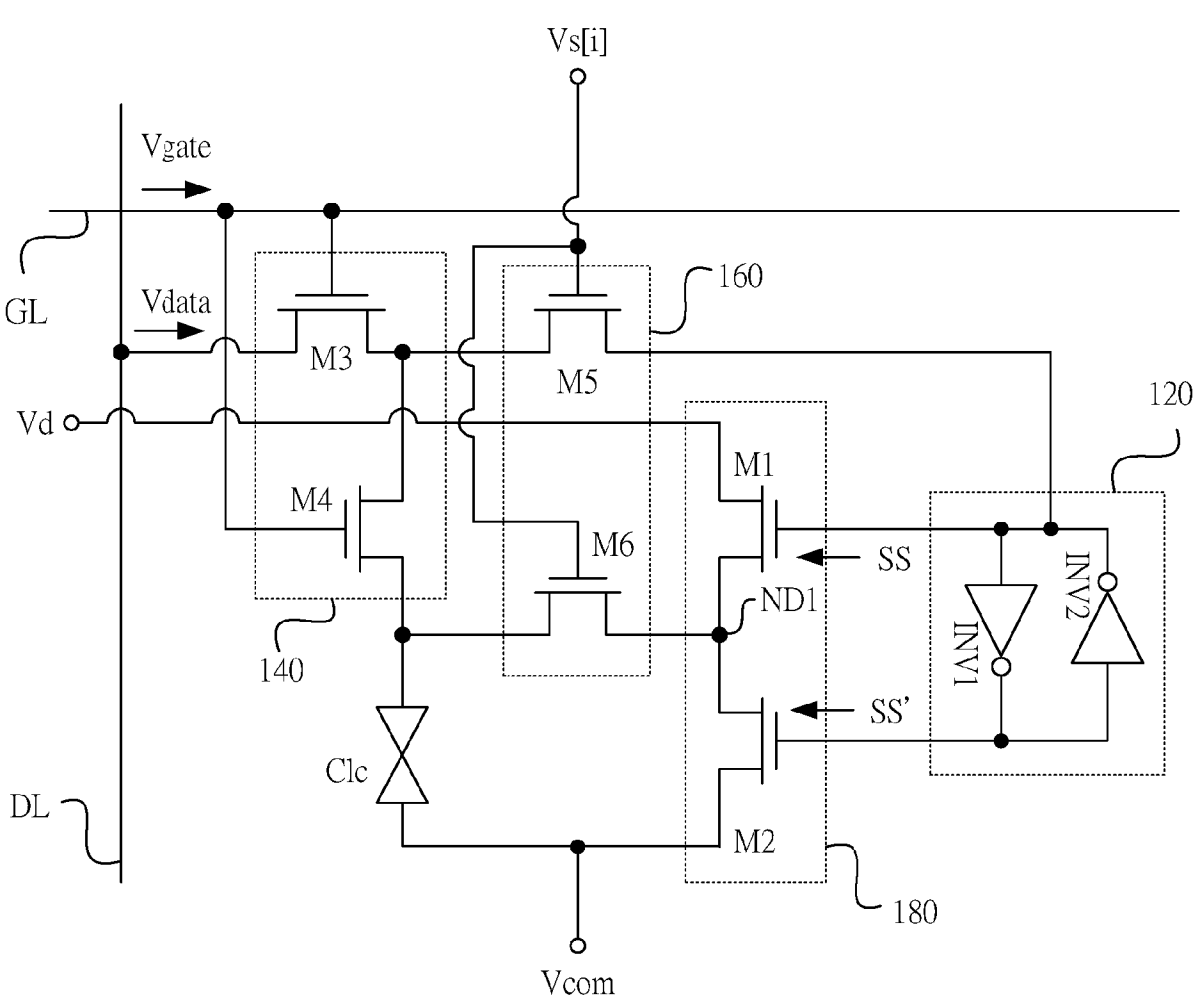
FIG. 1 is a schematic diagram of a pixel circuit according to some embodiments of this disclosure.

Referring to FIG. 1, FIG. 1 is a schematic diagram of a pixel circuit 100 according to some embodiment of this disclosure. As shown in FIG. 1, in some embodiments, the pixel circuit 100 includes a liquid crystal capacitor Clc, a memory circuit 120, a driving circuit 140, a mode-switching circuit 160, and a control circuit 180, where the memory circuit 120 is configured to store a status signal SS. In some embodiments, the pixel circuit 100 may be a switchable pixel circuit, may be used in a display panel that adopts memory-in-pixel, and keeps, by means of the built-in memory circuit 120, providing an image displayed by the display panel when the image is not updated. The liquid crystal capacitor may be composed of display medium and other layers in the display panel. The display medium may be liquid crystal.

Specifically, the pixel circuit 100 may operate in a normal mode and a still mode. When the pixel circuit 100 operates in the normal mode, the pixel circuit 100 drives the liquid crystal capacitor Clc via a data voltage Vdata on a data line DL. According to another aspect, when the pixel circuit 100 switches to the still mode, the pixel circuit 100 drives the liquid crystal capacitor Clc according to the status signal SS stored in the memory circuit 120. Therefore, when an image on the display screen is not updated, the image may be provided via the status signal SS stored in the memory circuit 120, so that the time for driving the liquid crystal capacitor Clc via a scan signal Vgate and the data voltage Vdata can be reduced, thereby achieving the effect of reducing power consumption. The following paragraphs describe circuit structures in the pixel circuit 100 and corresponding operations with reference to the figures.

As shown in FIG. 1, in structure, the liquid crystal capacitor Clc includes a first terminal and a second terminal, where the first terminal is electrically coupled to the driving circuit 140, and the second terminal is configured to receive a common reference voltage Vcom. The driving circuit 140 includes a first terminal, a second terminal, and a control terminal, where the first terminal is electrically coupled to the data line DL and configured to receive the data voltage Vdata, the second terminal is electrically connected to the first terminal of the liquid crystal capacitor Clc, and the control terminal is electrically coupled to the scan line GL and configured to receive the scan signal Vgate.

Specifically, in some embodiments, the driving circuit 140 is configured to be ON or OFF according to the scan signal Vgate selectively, so as to charge the liquid crystal capacitor Clc according to the data voltage Vdata, or to enable the memory circuit 120 to store the status signal SS according to the data voltage Vdata. For example, when the pixel circuit 100 is in the normal mode, the data voltage Vdata charges the liquid crystal capacitor Clc via the driving circuit 140 that is ON. Relatively, when the pixel circuit 100 is switching from the normal mode to the still mode, the pixel circuit 100 first operates in a pre-still mode, so that the data voltage Vdata is transmitted to the memory circuit 120 via the driving circuit 140 that is ON. In this way, the memory circuit 120 can store or update the status signal SS according to the data voltage Vdata. In some embodiments, the pixel circuit 100 performs control according to the mode-switching circuit 160, so as to operate in the normal mode or operate in the still mode. Specifically, the mode-switching circuit 160 is electrically connected to the memory circuit 120, the driving circuit 140, and the control circuit 180, and is configured to be ON or OFF according to a mode-switching signal Vs[i] selectively, so as to enable the pixel circuit 100 to switch to a corresponding operation mode. For example, in some embodiments, when the mode-switching signal Vs[i] is of a low level, the mode-switching circuit 160 is OFF, and the pixel circuit 100 is in the normal mode. Relatively, when the mode-switching signal Vs[i] is of a high level, the mode-switching circuit 160 is ON, and the pixel circuit 100 is in the still mode.

In some embodiments, the control circuit 180 is electrically connected to the mode-switching circuit 160 at a node ND1. The control circuit 180 is configured to control a voltage level of the node ND1 corresponding to the status signal SS stored in the memory circuit 120, and output, when the pixel circuit 100 is in the still mode, a display voltage (for example, the voltage of the node ND1) to the liquid crystal capacitor Clc via the mode-switching circuit 160. In other words, in some embodiments, the control circuit 180 is configured to output, when the mode-switching circuit 160 is ON, the display voltage to the liquid crystal capacitor Clc via the mode-switching circuit 160.

In this way, by means of mutual operations of the memory circuit 120, the driving circuit 140, the mode-switching circuit 160, and the control circuit 180, the pixel circuit 100 can transmit, when being in the normal mode, the data voltage Vdata via the driving circuit 140, so as to drive the liquid crystal capacitor Clc, and drive, when being in the still mode, the liquid crystal capacitor Clc via the mode-switching circuit 160 and the control circuit 180 according to the status signal SS stored in the memory circuit 120, thereby saving power. The following paragraphs further illustrate specific circuit elements in the operation circuits in the embodiments shown in FIG. 1, and implementation manners.

As shown in FIG. 1, in some embodiments, the control circuit 180 includes a transistor M1 and a transistor M2. In structure, a first terminal of the transistor M1 is configured to receive the drive voltage Vd when the mode-switching circuit 160 is ON. Specifically, in some embodiments, the drive voltage Vd may be a voltage signal reverse to the common reference voltage Vcom. A second terminal of the transistor M1 is electrically connected to the node ND1. A control terminal of the transistor M1 is electrically connected to a first terminal of the memory circuit 120, and is configured to receive the status signal SS. A first terminal of the transistor M2 is electrically connected to the node ND1. In other words, the first terminal of the transistor M2 and the second terminal of the transistor M1 are electrically connected to each other. A second terminal of the transistor M2 is electrically connected to a second terminal of the liquid crystal capacitor Clc, so as to receive the common reference voltage Vcom. A control terminal of the transistor M2 is electrically connected to a second terminal of the memory circuit 120, and is configured to receive an inverted phase signal SS' with an inverted phase of that of the status signal SS.

Besides, in some embodiments, the memory circuit 120 includes an inverter INV1 and an inverter INV2. An input terminal of the inverter INV1 is electrically connected to the control terminal of the transistor M1, and configured to provide the status signal SS. An output terminal of the inverter INV1 is electrically connected to the control terminal of the transistor M2, and configured to provide the inverted phase signal SS'. An input terminal of the inverter INV2 is electrically connected to the output terminal of the inverter INV1. An output terminal of the inverter INV2 is electrically connected to the input terminal of the inverter INV1. Therefore, the input terminal and the output terminal of the inverter INV1 are connected to the output terminal and the input terminal of the inverter INV2 respectively, forming a latch circuit structure having two stable statuses. In one of the stable statuses, the status signal SS is of a high level, and the inverted phase signal SS' is of a low level. In the other stable status, the status signal SS is of a low level, and the inverted phase signal SS' is of a high level.

Besides, in some embodiments, the driving circuit 140 includes a transistor M3 and a transistor M4. In structure, a first terminal of the transistor M3 is electrically connected to the data line DL, and is configured to receive the data voltage Vdata. A control terminal of the transistor M3 is electrically connected to the scan line GL, and is configured to receive the scan signal Vgate. A first terminal of the transistor M4 is electrically connected to a second terminal of the transistor M3. A second terminal of the transistor M4 is electrically connected to the first terminal of the liquid crystal capacitor Clc. A control terminal of the transistor M4 is electrically connected to the scan line GL, and is configured to receive the scan signal Vgate.

Besides, in some embodiments, the mode-switching circuit 160 includes a transistor M5 and a transistor M6. In structure, a first terminal of the transistor M5 is electrically connected to the second terminal of the transistor M3. A second terminal of the transistor M5 is electrically connected to the first terminal of the memory circuit 120. A control terminal of the transistor M5 is configured to receive the mode-switching signal Vs[i]. A first terminal of the transistor M6 is electrically connected to the first terminal of the liquid crystal capacitor Clc. A second terminal of the transistor M6 is electrically connected to the node ND1. In other words, the second terminal of the transistor M6 is electrically connected to the second terminal of the transistor M1 and the first terminal of the transistor M2 at the node ND1. A control terminal of the transistor M6 is configured to receive the mode-switching signal Vs[i].

Figure 2:
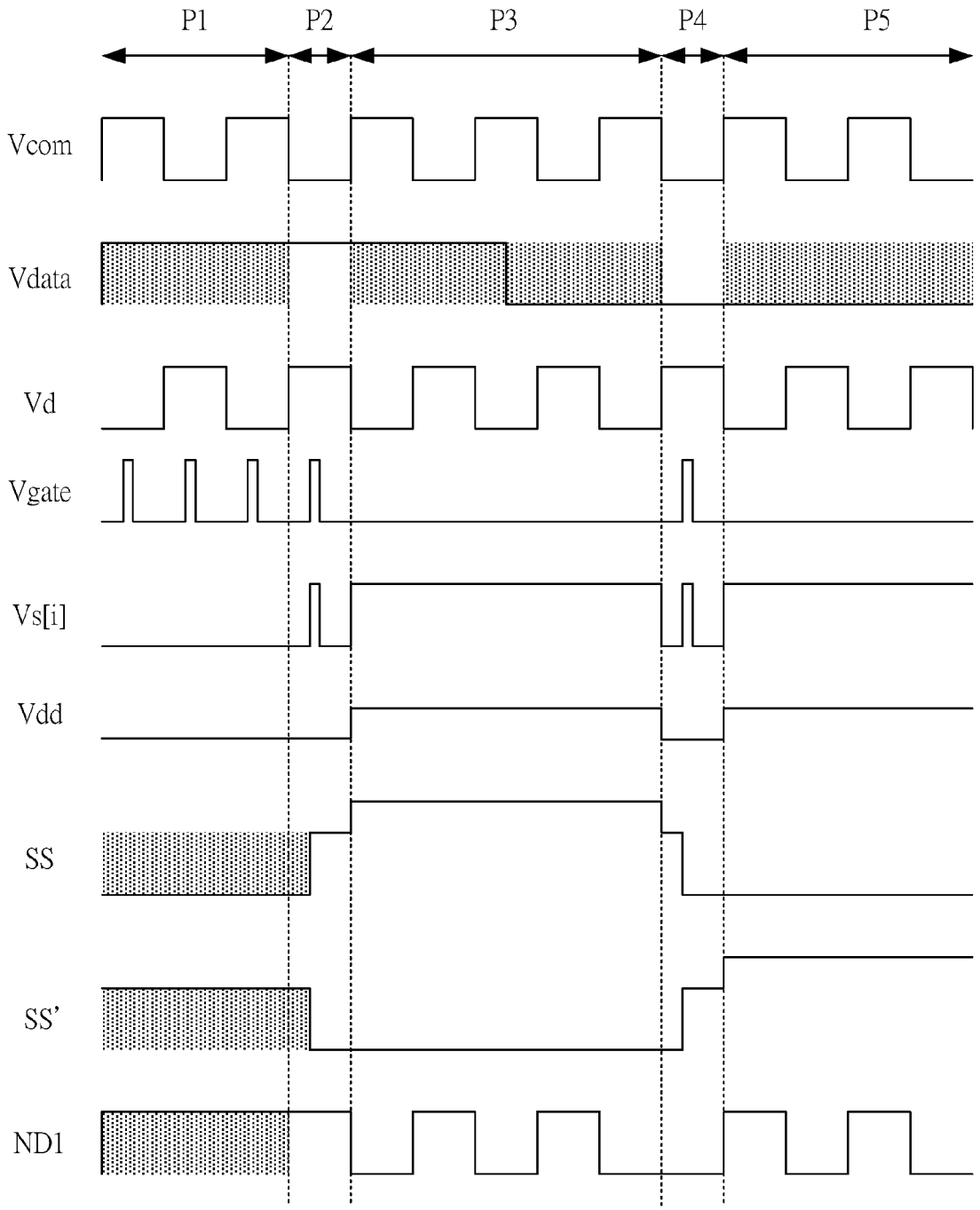
FIG. 2 is a schematic diagram of signal waveforms of the pixel circuit at different stages according to some embodiments of this disclosure.

To facilitate and clarify the description, reference is further made to FIG. 2. FIG. 2 is a schematic diagram of signal waveforms of the pixel circuit 100 at different stages according to some embodiments of this disclosure. The signal waveforms shown in FIG. 2 are described with reference to the embodiments shown in FIG. 1, but the present invention is not limited thereto.

As shown in FIG. 2, in a period P1, the pixel circuit 100 operates in a first mode (for example, the normal mode). At this time, the scan signal Vgate on the scan line GL switches from a low level to a high level by using a fixed frequency (for examples, 60 Hz), so as to enable the transistors M3, M4 in the driving circuit 140 to be ON. Besides, at this time, the mode-switching signal Vs[i] is of a low level, and the transistors M5, M6 in the mode-switching circuit 160 are kept OFF corresponding to the mode-switching signal Vs[i].

In this way, when the scan signal Vgate is of a high level, the transistor M3 and the transistor M4 are ON corresponding to the scan signal Vgate, and the liquid crystal capacitor Clc can receive the data voltage Vdata via the transistors M3, M4 of the driving circuit 140.

Subsequently, in a period P2, the pixel circuit 100 prepares to switch from the first mode (for example, the normal mode) to a second mode (for example, the still mode). At this time, the pixel circuit 100 is temporarily at the pre-still mode. In the pre-still mode, the mode-switching signal Vs[i] once switched from the low level to a high level, so as to enable the transistors M5, M6 in the mode-switching circuit 160 to be ON. In this way, the transistor M5 of the mode-switching circuit 160 is ON, and therefore, the first terminal of the memory circuit 120 can receive the data voltage Vdata via the transistor M3 of the driving circuit 140 and the transistor M5 of the mode-switching circuit 160, so as to store the status signal SS according to the data voltage Vdata.

As shown in FIG. 2, when the mode-switching circuit 160 is ON, the data voltage Vdata is of the high level, and the first terminal of the memory circuit 120 is kept at a high level due to the influence of an input voltage level. The second terminal of the memory circuit 120 is kept at a low level. In other words, at this time, the status signal SS output by the memory circuit 120 is of a high level, and the inverted phase signal SS' is of a low level.

Subsequently, in a period P3, the pixel circuit 100 operates in the second mode (for example, the still mode). At this time, the scan signal Vgate on the scan line GL is kept at a low level. In this way, the transistors M3, M4 in the driving circuit 140 are kept OFF. Besides, at this time, the mode-switching signal Vs[i] switches to the high level, and the transistor M5 and the transistor M6 are ON corresponding to the mode-switching signal Vs[i].

In the period P3, the modes-switching circuit 160 is ON, and therefore, the liquid crystal capacitor Clc can receive the display voltage at the node ND1 via the mode-switching circuit 160 and the control circuit 180.

Specifically, the control terminal of the transistor M1 in the control circuit 180 receives the status signal SS, and the control terminal of the transistor M2 receives the inverted phase signal SS'. In the period P3, the status signal SS output by the memory circuit 120 is of an enable level (for example, the high level), and the inverted phase signal SS' is of a disable level (for example, the low level). Therefore, the transistor M1 is ON accordingly, and the transistor M2 is OFF accordingly, so that the voltage of the node ND1 is the drive voltage Vd with an inverted phase of that of the common reference voltage Vcom. In this way, the first terminal of the liquid crystal capacitor Clc can receive the drive voltage Vd with an inverted phase of that of the common reference voltage Vcom via the transistor M1 in the control circuit 180 and the transistor M6 in the mode-switching circuit 160, and use the drive voltage Vd as the display voltage.

Subsequently, in a period P4, in order to update the status signal SS, the pixel circuit 100 is temporarily in the pre-still mode again. In the pre-still mode, the data line DL stops providing the drive voltage Vd with an inverted phase of that of the common reference voltage Vcom, but outputs, similar to the operation in the period P2, the data voltage Vdata that varies with the time, so as to provide the data signal. The driving circuit 140 is ON according to the scan signal Vgate selectively, so that the memory circuit 120 updates the stored status signal SS according to the data voltage Vdata.

As shown in FIG. 2, similar to the operation of the pixel circuit 100 in the period P2, in the pre-still mode, the mode-switching signal Vs[i] once switched from the low level to the high level, so as to enable the transistors M5, M6 in the mode-switching circuit 160 to be ON. In this way, the transistor M5 of the mode-switching circuit 160 is ON, and therefore, the first terminal of the memory circuit 120 can receive the data voltage Vdata via the transistor M3 of the driving circuit 140 and the transistor M5 of the mode-switching circuit 160, so as to update the stored status signal SS according to the data voltage Vdata. As shown in FIG. 2, in the period P4, when the mode-switching circuit 160 is ON, the data voltage Vdata is of the low level, and the first terminal of the memory circuit 120 is kept at the low level due to the influence of the input voltage level. The second terminal of the memory circuit 120 is kept at the high level. In other words, at this time, the status signal SS output by the memory circuit 120 is of the low level, and the inverted phase signal SS' is of the high level.

Subsequently, in a period P5, the pixel circuit 100 switches from the pre-still mode to the second mode (for example, the still mode) again. At this time, the drive voltage Vd is provided to the data line DL again, and is set to be of an inverted phase of that of the common reference voltage Vcom. The scan signal Vgate on the scan line GL is kept at the low level. In this way, the transistors M3, M4 in the driving circuit 140 are kept OFF. Besides, at this time, the mode-switching signal Vs[i] switches to the high level, so as to enable the transistors M5, M6 in the mode-switching circuit 160 to be ON.

Similar to the operation of the pixel circuit 100 in the period P3, in the period P5, the modes-switching circuit 160 is ON, and therefore, the liquid crystal capacitor Clc can receive the display voltage at the node ND1 via the mode-switching circuit 160 and the control circuit 180.

In the period P5, the status signal SS output by the memory circuit 120 is of a disable level (for example, the low level), and the inverted phase signal SS' is of an enable level (for example, the high level). Therefore, the transistor M1 is OFF accordingly, and the transistor M2 is ON accordingly, so that the voltage of the node ND1 is of a same phase of that of the common reference voltage Vcom. In this way, the first terminal of the liquid crystal capacitor Clc can be electrically connected to the second terminal of the liquid crystal capacitor Clc via the transistor M2 in the control circuit 180 and the transistor M6 in the mode-switching circuit 160, and receive the common reference voltage Vcom. In other words, at this time, the first terminal of the liquid crystal capacitor Clc receives the common reference voltage Vcom and uses the common reference voltage Vcom as the display voltage. Therefore, in the period P5, the first terminal and the second terminal of the liquid crystal capacitor Clc are of the same voltage level.

As shown in FIG. 2, by means of the foregoing operations of the pixel circuit 100 in the period P3 and the period P5, when the status signal SS is of a first level (for example, the high level), the control circuit 180 controls that a voltage difference exists between the first terminal and the second terminal of the liquid crystal capacitor Clc. Specifically, the second terminal of the liquid crystal capacitor Clc receives the common reference voltage Vcom. The first terminal of the liquid crystal capacitor Clc receives the drive voltage Vd on the data line DL with an inverted phase of that of the common reference voltage Vcom, and uses the drive voltage Vd as the display voltage. Relatively, when the status signal SS is of a second level (for example, the low level), the control circuit 180 controls that the first terminal and the second terminal of the liquid crystal capacitor Clc have substantially equal voltage levels. Specifically, the first terminal of the liquid crystal capacitor Clc receives the common reference voltage Vcom, and uses the common reference voltage Vcom as the display voltage. Therefore, both of the first terminal and the second terminal of the liquid crystal capacitor Clc receive the common reference voltage Vcom.

In some embodiments, a working voltage Vdd for an operation of the memory circuit 120 may be adjusted according to the different modes of the pixel circuit 100. For example, in the normal mode and the pre-still mode of the periods P1, P2, P4, the working voltage Vdd may be of a relatively low voltage level (for example, about 5 V), so as to reduce power consumption and power loss. In the periods P1, P2, the working voltage Vdd may be of a relatively low voltage level (for example, about 5 V), so as to reduce power consumption and power loss. Relatively, in the still mode of the periods P3, P5, the working voltage Vdd may be of a relatively high voltage level (for example, about 8 V), so as to ensure the voltage levels of the status signal SS and the inverted phase signal SS', so that the transistors M1, M2 receiving the status signal SS and the inverted phase signal SS' can be normally switched on and switched off. As shown in FIG. 2, the status signal SS and the inverted phase signal SS' are of the low level about 5 V in the pre-still mode of the periods P2, P4, and are of the high level about 8V in the still mode of the periods P3, P5.

In this way, the pixel circuit 100 can implement, in the second mode (for example, the still mode), the operation of driving the liquid crystal capacitor Clc according to the status signal SS stored in the memory circuit 120. Therefore, when an image on the display screen is not updated, the image may be provided via the status signal SS stored in the memory circuit 120, so that the time for driving the liquid crystal capacitor Clc via the scan signal Vgate and the data voltage Vdata can be reduced, thereby achieving the effect of reducing power consumption.

Besides, the control terminals of the transistors M1, M2 in the memory circuit 120 and the control circuit 180 are electrically connected, and the status signal SS and the inverted phase signal SS' are output from the memory circuit 120 to control the switching on and the switching off of the transistors M1, M2, thereby avoiding the problem of an error in recording the status signal SS by the memory circuit 120 resulted from a sudden decrease or a sudden increase in the levels of the two terminals of the memory circuit 120 caused by influences of a transistor voltage division effect or the levels being coupled to the common reference voltage Vcom. Therefore, a process permissible range of the pixel circuit 100 may be further improved, and a frame flicker phenomenon in a process of switching between different modes can be avoided.

A person of ordinary skill in the art shall understand that the specific circuit shown in FIG. 1 is for illustration only, is one of the possible implementation manners of this disclosure, and is not intended to limit this disclosure.

Figure 3:
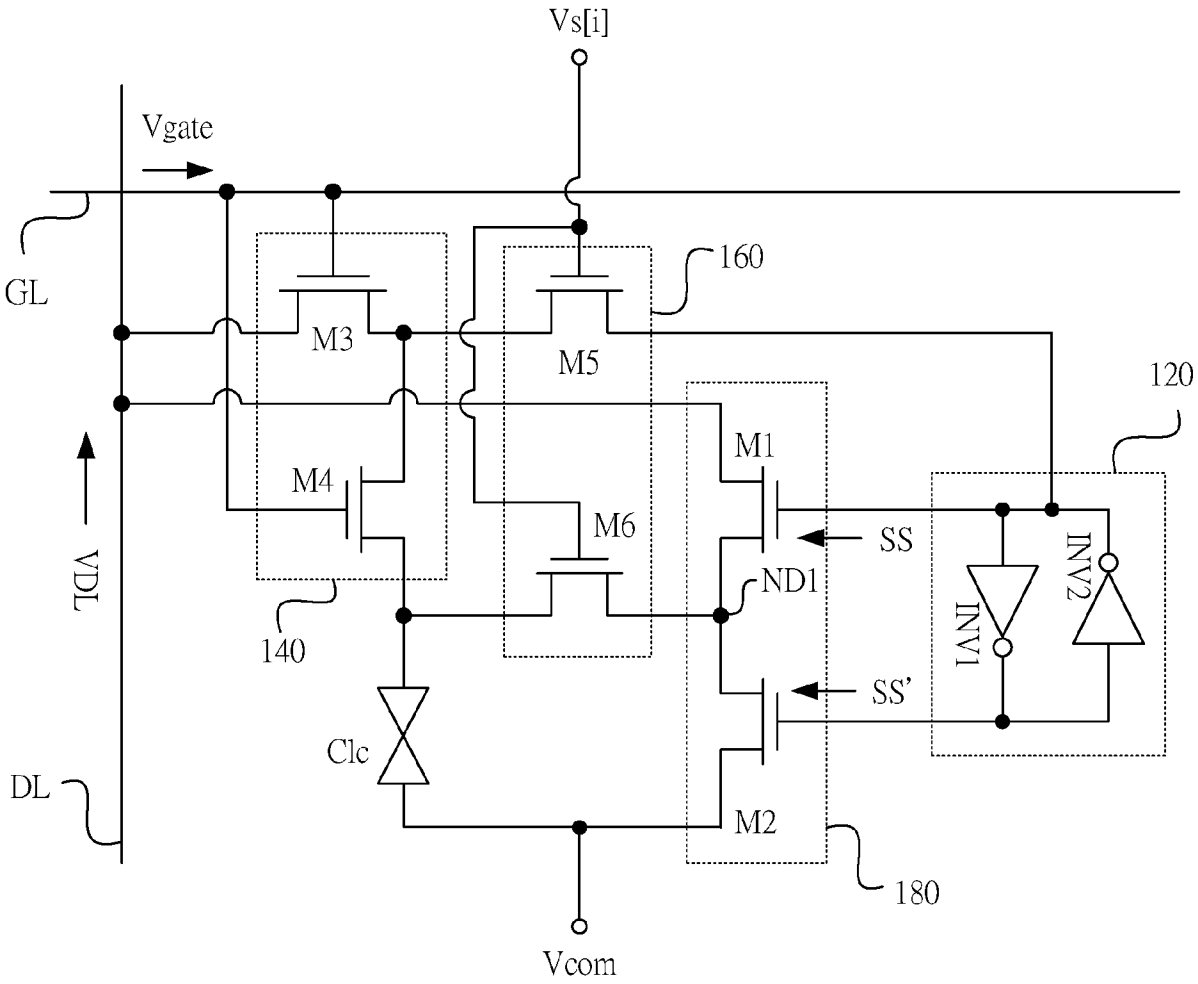
FIG. 3 is a schematic diagram of a pixel circuit according to some embodiments of this disclosure.

For example, reference is made to FIG. 3. FIG. 3 is a schematic diagram of a pixel circuit 100 according to some embodiments of this disclosure. In FIG. 3, like elements related to the embodiments of FIG. 1 are indicated by like reference signs, so as to facilitate the comprehension, and specific principles of the like elements are described in the foregoing paragraphs in detail, and the details are not described herein again unless the like elements cooperatively operate with the elements of FIG. 3 and therefore must be introduced.

As compared with the embodiments shown in FIG. 1, in the embodiments shown in FIG. 3, the first terminal of the transistor M1 in the control circuit 180 is electrically connected to the data line DL. In other words, in some embodiments, a data line voltage VDL on the data line DL can separately provides the data voltage Vdata and the drive voltage Vd in different periods P1 to P5.

Figure 4:
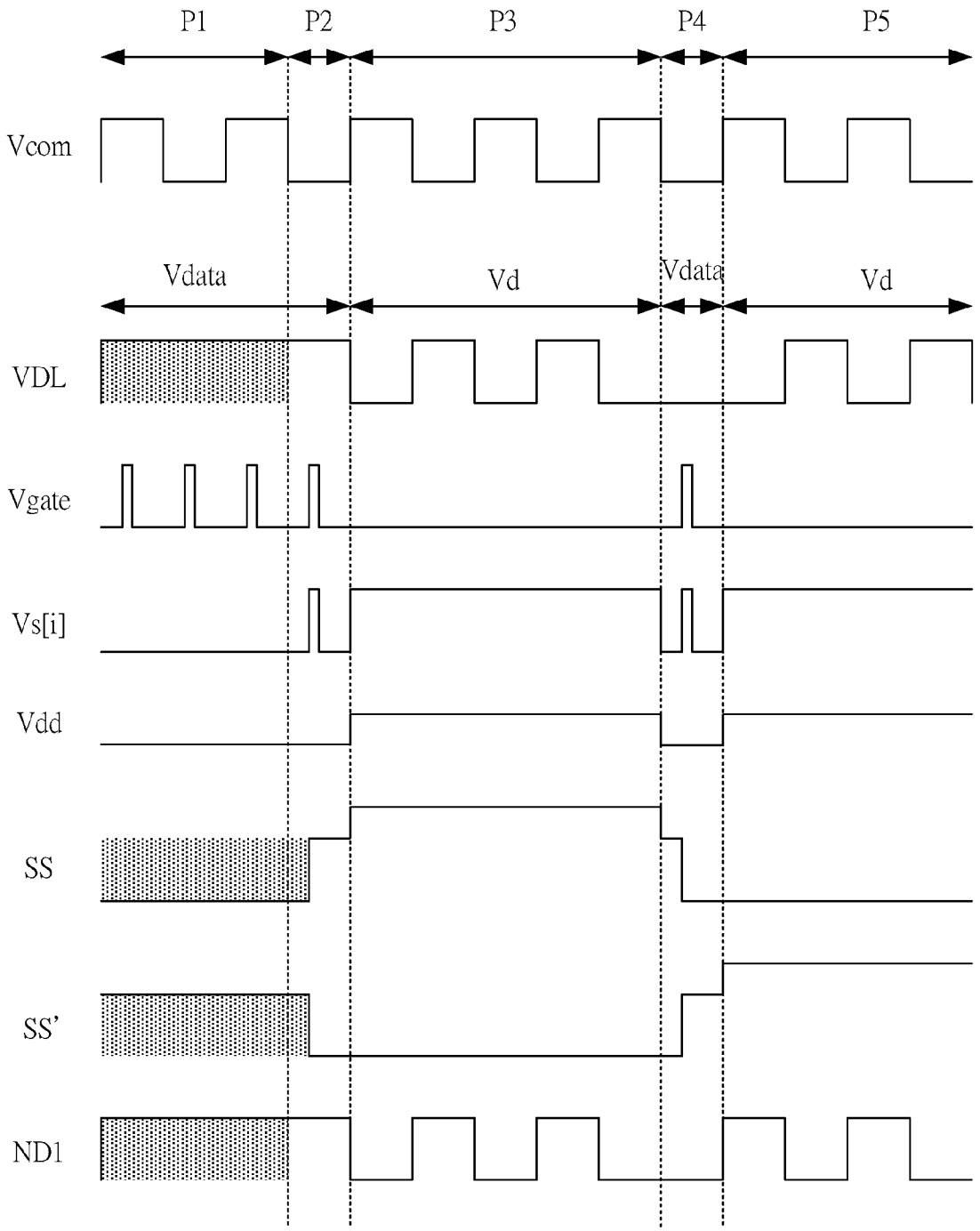
FIG. 4 is a schematic diagram of signal waveforms of the pixel circuit at different stages according to some embodiments of this disclosure.

To facilitate and clarify the description, reference is further made to FIG. 4. FIG. 4 is a schematic diagram of signal waveforms of the pixel circuit 100 at different stages according to some embodiments of this disclosure. The signal waveforms shown in FIG. 4 are described with reference to the embodiments shown in FIG. 3, but the present invention is not limited thereto.

As shown in FIG. 4, when the pixel circuit 100 operates in the still mode (for example, the periods P3, P5), the data line DL does not need to provide the data voltage Vdata to drive the liquid crystal capacitor Clc. According to another aspect, when the pixel circuit 100 operates in the normal mode and the pre-still mode (for example, the periods P1, P2, P4), the pixel circuit 100 does not need to provide the drive voltage Vd to drive the liquid crystal capacitor Clc, and does not need to provide the drive voltage Vd for the control circuit 180 to use the drive voltage Vd as a display voltage. Therefore, in some embodiments, the pixel circuit 100 can separately provide, via a same signal line in different modes, the drive voltage Vd to the control circuit 180, or the data voltage Vdata to the driving circuit 140.

For example, in some embodiments, in the periods P1, P2, the data line voltage VDL on the data line DL is the data voltage Vdata that varies with the time, so as to enable the driving circuit 140 to drive the liquid crystal capacitor Clc, and enable the memory circuit 120 to store the status signal SS according to the data voltage Vdata. Subsequently, in the period P3, the data line voltage VDL on the data line DL is the drive voltage Vd that is set to be of an inverted phase of that of the common reference voltage Vcom. Subsequently, in the period P4, the data line voltage VDL on the data line DL is set as the data voltage Vdata that varies with the time again, so as to enable the memory circuit 120 to update the stored status signal SS according to the data voltage Vdata again. Subsequently, in the period P5, the data line voltage VDL on the data line DL is set as the drive voltage Vd with the inverted phase of that of the common reference voltage Vcom again.

Therefore, in the embodiments shown in FIG. 3, the first terminal of the transistor M1 in the control circuit 180 can be electrically connected to the data line DL, and receive the drive voltage Vd via the data line DL, thereby simplifying the circuit design of the pixel circuit 100.

In FIG. 4, the remaining signal waveforms are similar to those of the embodiments of FIG. 2, and the specific principles of cooperative operations of the signal waveforms and the pixel circuit 100 are described in the foregoing paragraphs in detail, and therefore are not described herein again.

Figure 5:
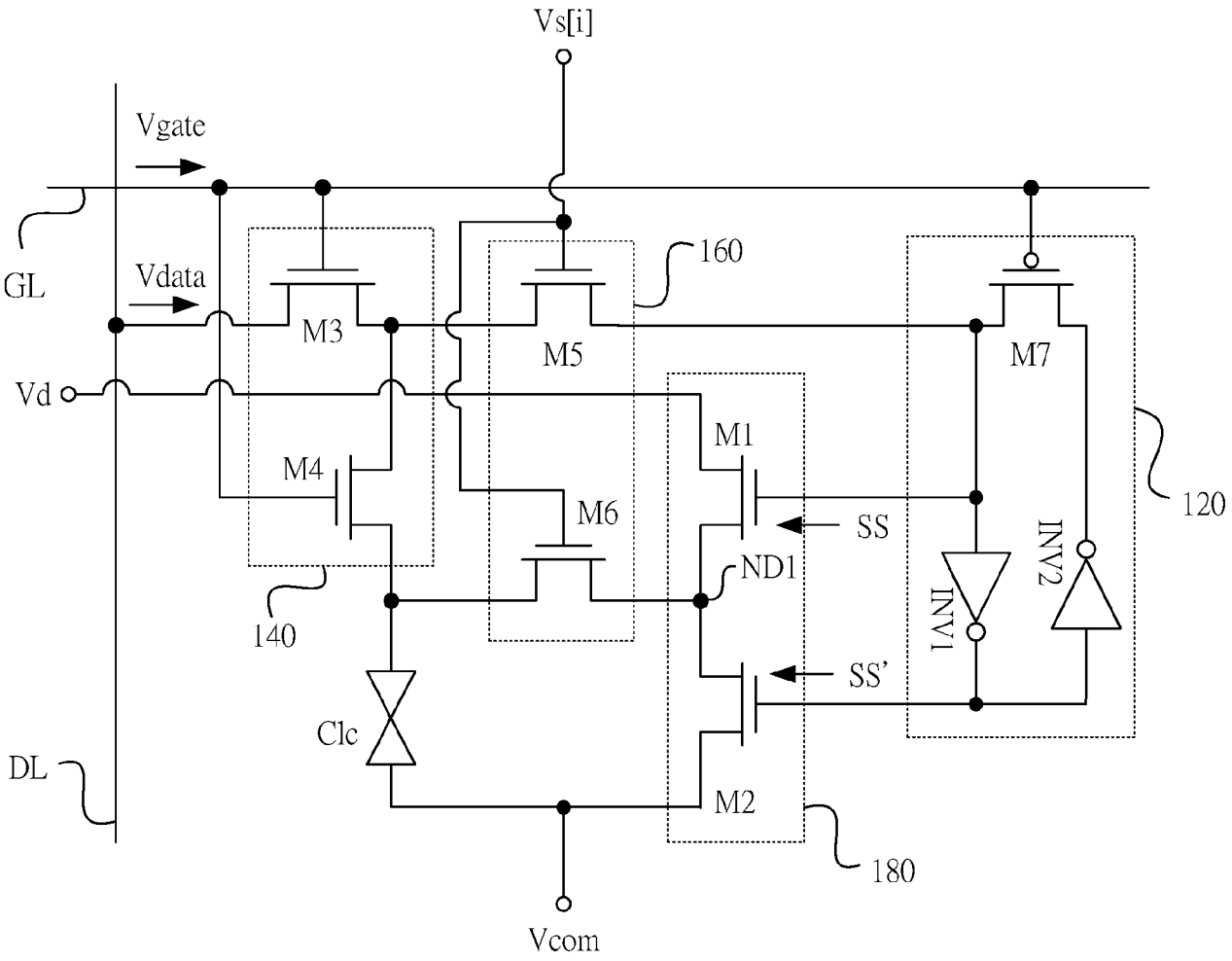
FIG. 5 is a schematic diagram of a pixel circuit according to some embodiments of this disclosure.

Referring to FIG. 5, FIG. 5 is a schematic diagram of a pixel circuit 100 according to some embodiments of this disclosure. In FIG. 5, like elements related to the embodiments of FIG. 1 are indicated by like reference signs, so as to facilitate the comprehension, and specific principles of the like elements are described in the foregoing paragraphs in detail, and the details are not described herein again unless the like elements cooperatively operate with the elements of FIG. 5 and therefore must be introduced. As compared with the embodiments shown in FIG. 1, in the embodiments shown in FIG. 5, the memory circuit 120 further includes a transistor M7. In structure, a first terminal of the transistor M7 is electrically connected to the input terminal of the inverter INV1, and a second terminal of the transistor M7 is electrically connected to the output terminal of the inverter INV2. A control terminal of the transistor M7 is electrically connected to the scan line GL, and is configured to receive the scan signal Vgate. In some embodiments, the transistor M7 may adopt a transistor of a different type of the type of the transistor M3. For example, in some embodiments, the transistors M1 to M6 may be N-type metal-oxide semiconductor field-effect transistors (NMOSs), and the transistor M7 may be a P-type metal-oxide semiconductor field-effect transistor (PMOS).

Therefore, when the transistor M3 is ON corresponding to the scan signal Vgate, so as to charge the liquid crystal capacitor Clc, the transistor M7 is OFF, so as to enable the latch of the memory circuit 120 to be interrupted. By means of setting the transistor M7 to interrupt the latch of the memory circuit 120, the process permissible range of the pixel circuit 100 is further improved.

Figure 6:
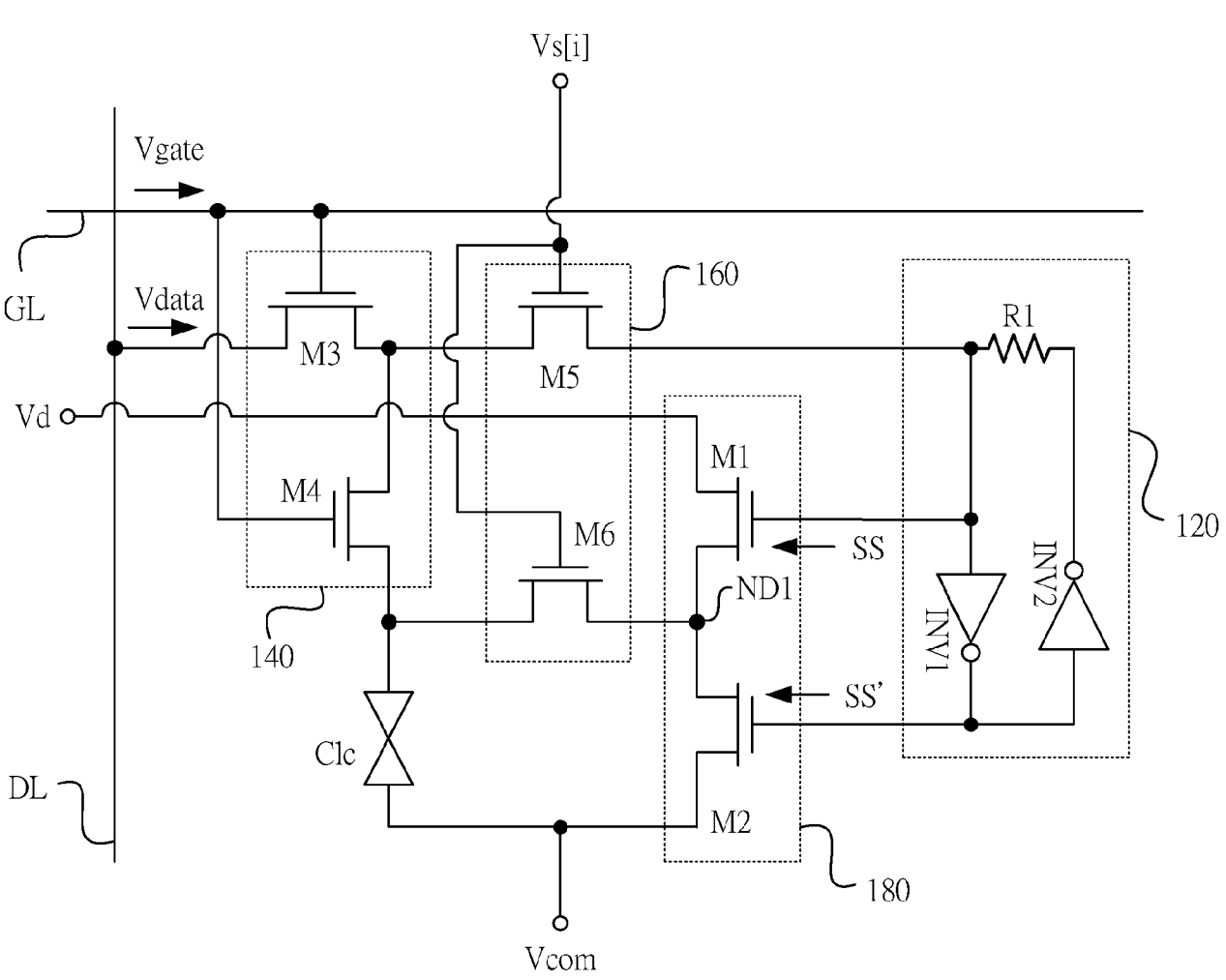
FIG. 6 is a schematic diagram of a pixel circuit according to some embodiments of this disclosure.

Referring to FIG. 6, FIG. 6 is a schematic diagram of a pixel circuit 100 according to some embodiments of this disclosure. In FIG. 6, like elements related to the embodiments of FIG. 1 are indicated by like reference signs, so as to facilitate the comprehension, and specific principles of the like elements are described in the foregoing paragraphs in detail, and the details are not described herein again unless the like elements cooperatively operate with the elements of FIG. 6 and therefore must be introduced. As compared with the embodiments shown in FIG. 1, in the embodiments shown in FIG. 6, the memory circuit 120 further includes a resistor R1. The resistor R1 is electrically connected between the input terminal of the inverter INV1 and the output terminal of the inverter INV2.

Similar to the function of the transistor M7 in the embodiments shown in FIG. 5, in these embodiments, when the status signal SS is updated, the resistor R1 may be regarded as open, so as to interrupt the latch of the memory circuit 120, thereby further improving the process permissible range of the pixel circuit 100. In some embodiments, the volume of the resistor R1 is smaller than that of the transistor M7 in the embodiments shown in FIG. 5, thereby further reducing the circuit area of the memory circuit 120.

Figure 7:
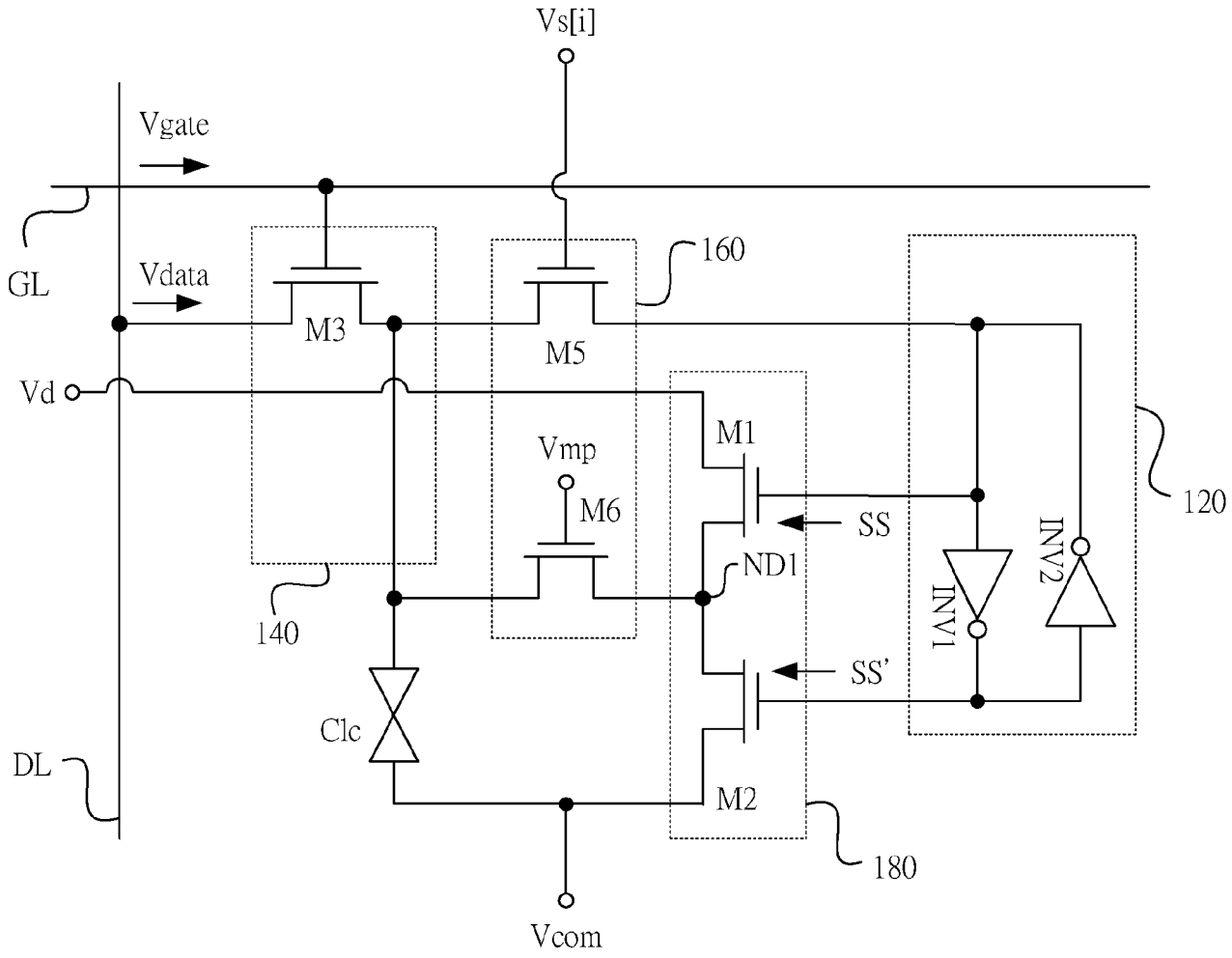
FIG. 7 is a schematic diagram of a pixel circuit according to some embodiments of this disclosure.

Referring to FIG. 7, FIG. 7 is a schematic diagram of a pixel circuit 100 according to some embodiments of this disclosure. In FIG. 7, like elements related to the embodiments of FIG. 1 are indicated by like reference signs, so as to facilitate the comprehension, and specific principles of the like elements are described in the foregoing paragraphs in detail, and the details are not described herein again unless the like elements cooperatively operate with the elements of FIG. 7 and therefore must be introduced. As compared with the embodiments shown in FIG. 1, in the embodiments shown in FIG. 7, the second terminal of the transistor M3 in the driving circuit 140 is electrically connected to the first terminal of the transistor M5 and the first terminal of the transistor M6 that are in the mode-switching circuit 160. In other words, the driving circuit 140 in this embodiment may be implemented by only one transistor switch.

Besides, as shown in FIG. 7, in this embodiment, the control terminal of the transistor M6 is configured to receive another independent mode-switching signal Vmp. In other words, the control terminals of the transistor M5 and the transistor M6 are not coupled to each other to make the transistor M5 and the transistor M6 be switched on and switched off corresponding to a same signal, but the operations of the transistor M5 and the transistor M6 are controlled separately according to the mode-switching signal Vs[i] and a mode-switching signal Vmp that are different.

Specifically, in some embodiments, in the normal mode and the pre-still mode of the periods P1, P2, P4, the mode-switching signal Vmp is of a disable level, so that the transistor M6 is kept OFF. In other words, in the pre-still mode of the periods P2, P4, when the transistor M5 is ON so as to write or update the status signal SS, the transistor M6 is not ON. Relatively, in the still mode of the periods P3, P5, the mode-switching signal Vmp is of an enable level, so that the transistor M6 is ON, and the voltage of the node ND1 can be transmitted to the liquid crystal capacitor Clc via the transistor M6, the voltage being used as the display voltage. At this time, the mode-switching signal Vs[i] can switch to the disable level, so as to switch off the transistor M5. The transistor M5 cuts off a path between the first terminal of the liquid crystal capacitor Clc and the memory circuit 120, and therefore, the status signal SS stored in the memory circuit 120 can be kept at a corresponding stable status in the still mode without being affected by circuit feedback.

In this way, the pixel circuit 100 can further reduce the number of used transistor elements, thereby accordingly reducing the costs and the circuit area of the pixel circuit 100.

To sum up, a person of ordinary skill in the art shall understand that the circuit circuits in the pixel circuit 100 may be implemented by using multiple types of different specific circuits, and the specific circuit shown in the foregoing embodiments is merely one of the possible implementation manners of this disclosure, and is not intended to limit this disclosure.

Figure 8:
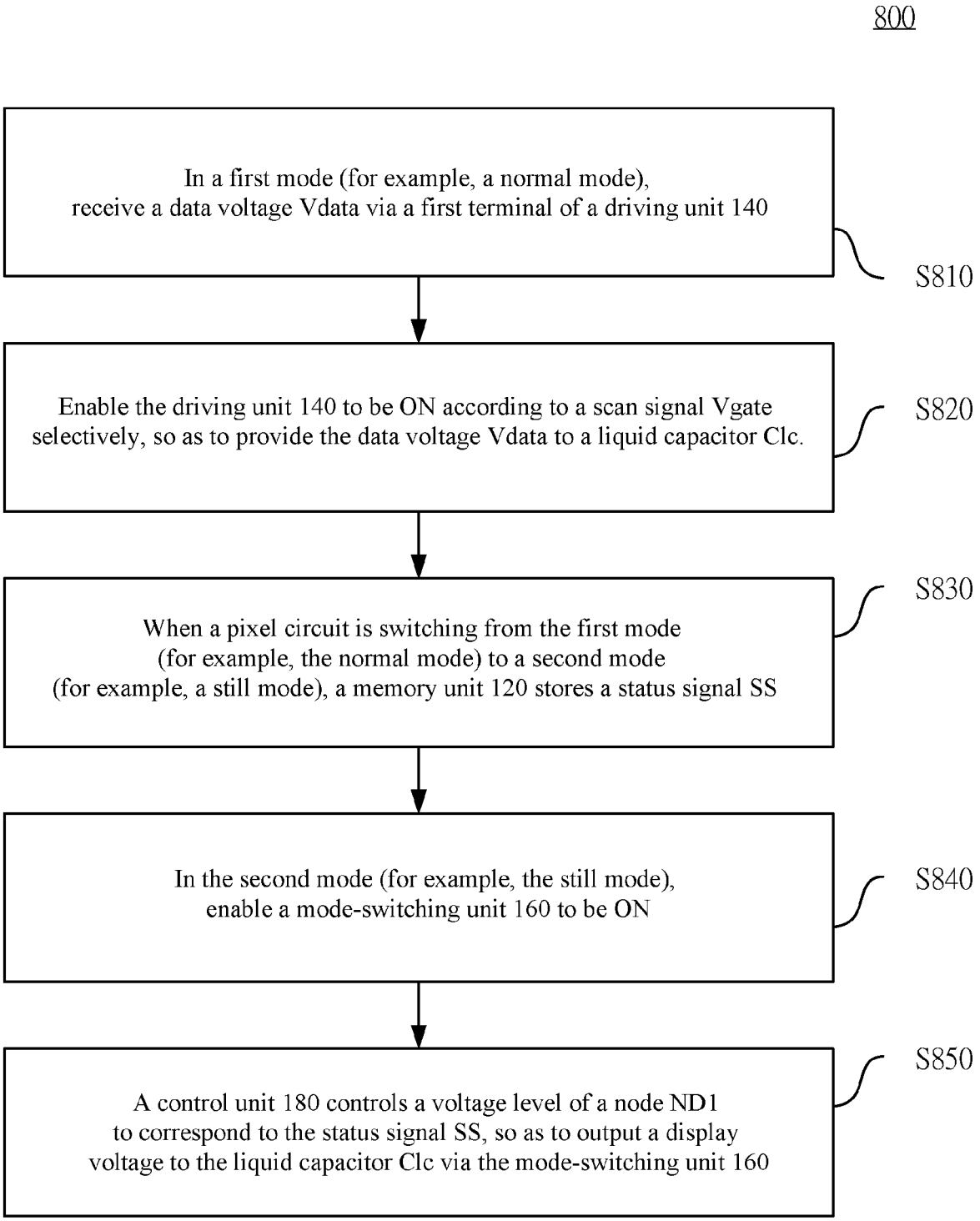
FIG. 8 is a flowchart of a driving method of a pixel circuit according to some embodiments of this disclosure.

Referring to FIG. 8, FIG. 8 is a flowchart of a driving method 800 of a pixel circuit 100 according to some embodiments of this disclosure. To facilitate and clarify the description, the following driving method 800 is described with reference to the embodiments shown in FIG. 1 to FIG. 7, but the present invention is not limited thereto. A person skilled in the art can make variations and modifications without departing from the spirit and scope of this disclosure. As shown in FIG. 8, the driving method 800 includes steps s810, s820, s830, s840, and s850.

First, in step s810, in the first mode (for example, the normal mode), receive the data voltage Vdata via the first terminal of the driving circuit 140. Subsequently, in step s820, enable the driving circuit 140 to be ON according to the scan signal Vgate selectively, so as to provide the data voltage Vdata to the liquid crystal capacitor Clc.

Subsequently, in step s830, when the pixel circuit is switching from the first mode (for example, the normal mode) to the second mode (for example, the still mode), the memory circuit 120 stores the status signal SS. Specifically, in some embodiments, when the pixel circuit is switching from the first mode to the second mode, the mode-switching circuit 160 is ON, so that the memory circuit 120 stores the status signal SS according to the data voltage Vdata, as shown in the period P2 in the embodiments of FIG. 2.

Subsequently, in step S840, in the second mode (for example, the still mode), enable the mode-switching circuit 160 to be ON, as shown in the periods P3, P5 in the embodiments of FIG. 2.

Finally, in step s850, the control circuit 180 controls the voltage level of the node ND1 to correspond to the status signal SS, so as to output the display voltage to the liquid crystal capacitor Clc via the mode-switching circuit 160. Specifically, in some embodiments, the step of outputting the display voltage to the liquid crystal capacitor Clc in step s850 may further include outputting, when the status signal SS is of the first level (for example, the high level), the display voltage to enable the voltage difference to exist between the first terminal and the second terminal of the liquid crystal capacitor Clc (as shown in the period P3 in the embodiments of FIG. 2), and outputting, when the status signal SS is of the second level (for example, the low level), the display voltage to enable the first terminal and the second terminal of the liquid crystal capacitor Clc to have the equal voltage levels (as shown in the period P5 in the embodiments of FIG. 2).

Besides, as described in the foregoing paragraphs, in some embodiments, when the pixel circuit is switching from the first mode (for example, the normal mode) to the second mode (for example, the still mode), the driving circuit 140 and the mode-switching circuit 160 may be enabled to be On selectively, so that the memory circuit 120 updates the status signal SS according to the new data voltage Vdata, as shown in the period P4 in the embodiments of FIG. 2.

A person of ordinary skill in the art can directly understand how the driving method 800 implements such operations and functions on the basis of the pixel circuits 100 in the foregoing multiple different embodiments, and therefore, details are not described herein again.

Although this specification shows and describes the disclosed method as a series of steps or events, it shall be understood that the shown sequence of the steps or events shall not be construed as a limiting meaning. For example, some steps may occur in a different sequence and/or synchronously occur with steps or events other than the steps or events shown and/or described in this specification. In addition, when one or more aspects or embodiments described in this specification is or are implemented, not all the shown steps must be implemented. Besides, one or more steps in this specification may be executed in one or more separated steps and/or stages.

To sum up, this disclosure uses the pixel circuit 100 and the driving method 800 in the foregoing multiple embodiments to switch between the normal mode and the still mode, thereby reducing the time for driving, via the scan signal Vgate and the data voltage Vdata, the liquid crystal capacitor Clc, and achieving the effect of reducing power consumption. Besides, the operations are performed by means of the circuit architecture of the pixel circuit 100 and the corresponding driving method 800, thereby avoiding the problem of an error in recording the status signal SS by the memory circuit 120 resulted from a sudden decrease or a sudden increase in voltage levels. Therefore, a process permissible range of the pixel circuit 100 may be further improved, and a frame flicker phenomenon in a ode switching process can be avoided.

In each of the embodiments of this disclosure, elements such as the transistors M1 to M7, the resistor R1, the inverters INV1, INV2, and the liquid crystal capacitor Clc may be implemented by using proper electronic circuit elements. Besides, in a case of not conflicting, the features and circuits in the figures and embodiments of this disclosure may be combined with each other. The circuits shown in the figures are for an illustrative purpose only, are simplified to make the description concise and easily comprehensible, but are not intended to limit this disclosure.

Although this disclosure is described above by means of the embodiments, the above description is not intended to limit the present invention. A person skilled in the art can make various variations and modifications without departing from the spirit and scope of this disclosure, and therefore, the protection scope of this disclosure is as defined in the appended claims.

What is claimed is:

1. A pixel circuit, comprising:

a liquid crystal capacitor with a first end and a second end;

a memory circuit, for storing a status signal;

a driving circuit, for receiving a data voltage from a data line and outputting the data voltage to the liquid crystal capacitor and a mode-switching circuit according to a scan signal of a gate line;

the mode-switching circuit, for outputting the data voltage to the memory circuit and outputting a display voltage to the liquid crystal capacitor according to a mode-switching signal; and a control circuit, electrically connecting to the first end of the liquid crystal capacitor via the mode-switching circuit, connecting to the mode-switching circuit via a first node, and connecting to the second end of the liquid crystal capacitor, wherein the control circuit controls a voltage level of the first node corresponding to the status signal, and outputting the display voltage to the first end of the liquid crystal capacitor via the mode-switching circuit when the mode-switching circuit is ON.

2. The pixel circuit according to claim 1, wherein the control circuit comprises:

a first transistor, comprising:

a first terminal, for receiving a drive voltage; and a second terminal, electrically connecting to the first node; and a first control terminal, for receiving the status signal; and a second transistor, comprising:

a third terminal, electrically connected to the first node;

a fourth terminal, electrically connected to a second terminal of the liquid crystal capacitor; and a second control terminal, for receiving an inverted phase signal with an inverted phase of that of the status signal.

3. The pixel circuit according to claim 2, wherein the memory circuit comprises:

a first inverter, comprising:

a first input terminal, electrically connecting to the first control terminal of the first transistor; and a first output terminal, electrically connected to the second control terminal of the second transistor, for providing the inverted phase signal; and a second inverter, comprising:

a second input terminal, electrically connected to the first output terminal of the first inverter; and a second output terminal, electrically connected to the first input terminal of the first inverter.

4. The pixel circuit according to claim 3, wherein the memory circuit further comprises a seventh transistor comprising a thirteenth terminal and a fourteenth terminal, the thirteenth terminal of the seventh transistor electrically connects to the first input terminal of the first inverter, and the fourteenth terminal of the seventh transistor electrically connects to the second output terminal of the second inverter.

5. The pixel circuit according to claim 3, wherein the memory circuit further comprises a resistor, and the resistor electrically connects between the first input terminal of the first inverter and the second output terminal of the second inverter.

6. The pixel circuit according to claim 2, wherein the driving circuit comprises:

a third transistor, comprising:

a fifth terminal, electrically connecting to a data line, for receiving the data voltage;

a sixth terminal; and a third terminal, electrically connecting to a scan line, for receiving the scan signal; and the mode-switching circuit comprises:

a fourth transistor, comprising:

a seventh terminal, electrically connecting to the sixth terminal of the third transistor;

a eighth terminal, electrically connecting to the memory circuit; and a fourth control terminal, for receiving the mode-switching signal; and a fifth transistor, comprising:

a ninth terminal, electrically connecting to the first liquid crystal terminal of the liquid crystal capacitor;

a tenth terminal, electrically connecting to the first node; and a fifth control terminal, for receiving a second mode-switching signal.

7. The pixel circuit according to claim 1, wherein the driving circuit comprises:

a third transistor, comprising:

a fifth terminal, electrically connected to a data line, for receiving the data voltage;

a sixth terminal; and a third control terminal, electrically connecting to a scan line, for receiving the scan signal; and a fourth transistor, comprising:

a seventh terminal, electrically connecting to the sixth terminal of the third transistor;

an eighth terminal, electrically connecting to the first liquid crystal terminal; and a fourth control terminal, electrically connecting to the scan line, for receiving the scan signal.

8. The pixel circuit according to claim 7, wherein the mode-switching circuit comprises:

a fifth transistor, comprising:

a ninth terminal, electrically connecting to the fifth sixth terminal of the third transistor;

a tenth terminal, electrically connecting to the memory circuit; and a fifth control terminal, for receiving the mode-switching signal; and a sixth transistor, comprising:

a eleventh terminal, electrically connecting to the first liquid crystal terminal;

a twelfth terminal, electrically connecting to the first node; and a fifth control terminal, for receiving the mode-switching signal.

9. The pixel circuit according to claim 1, wherein when the pixel circuit operates in a first mode, the mode-switching circuit is OFF, the liquid crystal capacitor receives the data voltage via the driving circuit; and wherein when the pixel circuit operates in a second mode, the mode-switching circuit is ON, and the liquid crystal capacitor receives the display voltage via the mode-switching circuit and the control circuit.

10. The pixel circuit according to claim 9, wherein the liquid crystal capacitor further comprises a second liquid crystal terminal with a second liquid crystal terminal voltage, and the first liquid crystal terminal has a first liquid crystal terminal voltage;

wherein when the pixel circuit operates in the second mode and the status signal is at a first level, the first liquid crystal terminal voltage is different from the second liquid crystal terminal voltage; and wherein when the status signal is at a second level, the first liquid crystal terminal voltage is as same as the second liquid crystal terminal voltage.

11. The pixel circuit according to claim 9, wherein when the pixel circuit switches from the first mode to the second mode and the mode-switching circuit is ON, the memory circuit stores the status signal according to the data voltage.

12. The pixel circuit according to claim 9, wherein when the pixel circuit switches from the first mode to the second mode and the driving circuit is ON according to the scan signal, the memory circuit updates the stored status signal according to the data voltage.

* * * * *